US006934994B2

(12) United States Patent
Oh et al.

(10) Patent No.: US 6,934,994 B2
(45) Date of Patent: Aug. 30, 2005

(54) VACUUM CLEANER

(75) Inventors: Jang-keun Oh, Gwangju (KR); Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 430 days.

(21) Appl. No.: 10/242,648

(22) Filed: Sep. 12, 2002

(65) Prior Publication Data

US 2003/0217432 A1 Nov. 27, 2003

(30) Foreign Application Priority Data

May 22, 2002 (KR) ..... 2002-28321

(51) Int. Cl.[7] ..... A47L 9/10; A47L 9/12

(52) U.S. Cl. ..... 15/328; 15/347; 15/352; 15/327.1

(58) Field of Search ..... 15/327.1, 327.2, 15/327.7, 328, 347, 350, 351, 352, 353

(56) References Cited

U.S. PATENT DOCUMENTS

| | | | | |
|---|---|---|---|---|
| 3,636,681 A | | 1/1972 | Batson et al. | |
| 3,856,488 A | | 12/1974 | Kato et al. | |
| 4,185,976 A | | 1/1980 | Kosik et al. | |
| 4,314,385 A | * | 2/1982 | Wimsatt et al. | 15/321 |
| 4,699,641 A | | 10/1987 | Barnes, Jr. | |
| 5,779,745 A | | 7/1998 | Kilstrom | |
| 5,935,279 A | | 8/1999 | Kilstrom | |
| 6,243,912 B1 | * | 6/2001 | Grey | 15/320 |
| 2002/0184731 A1 | * | 12/2002 | Moine et al. | 15/352 |
| 2003/0221277 A1 | * | 12/2003 | Oh et al. | 15/328 |

FOREIGN PATENT DOCUMENTS

| | | |
|---|---|---|
| DE | 9311579 | 11/1993 |
| DE | 10021594 | 11/2001 |
| EP | 0024636 | 3/1981 |
| GB | 2287418 | 9/1995 |
| GB | 2305623 | 4/1997 |
| GB | 2321181 | 7/1998 |
| JP | 49-62653 | 9/1947 |
| JP | 45-31661 | 12/1970 |
| JP | 59-119254 | 8/1984 |
| JP | 62-192130 | 8/1987 |
| JP | 2001-029287 | 2/2001 |
| JP | 2002-078652 | 3/2002 |

* cited by examiner

*Primary Examiner*—Terrence R. Till
(74) *Attorney, Agent, or Firm*—Ladas & Parry LLP

(57) ABSTRACT

A vacuum cleaner includes a dust-collecting chamber that is separated from the vacuum cleaner's motor chamber by a partition. The dust-collecting chamber is provided with disposable and reusable filters that separate and collect dusts and dirt from the air that is drawn into the dust-collecting chamber through an air inflow hole in the partition. The filters are supported by fixing guides disposed at sidewalls of an air inflow hole of the dust-collecting chamber.

10 Claims, 8 Drawing Sheets

VACUUM CLEANER

BACKGROUND OF THE INVENTION

1. Field of the Invention

The present invention relates generally to a vacuum cleaner, and more particularly, to a vacuum cleaner in which either a disposable paper filter or a permanently reusable filter is mounted.

2. Description of the Prior Art

As is well known, a vacuum cleaner has a basic structure in which dust and dirt are drawn in together with air by a suction force, which is generated at a suction port by a vacuum-generating device, and the dust and dirt are separated and collected from the air by a dust-collecting means.

The vacuum-generating device comprises a vacuum motor, which is disposed in a cleaner body. The cleaner body is provided with a motor chamber in which the vacuum motor is mounted and a dust-collecting chamber is in fluid communication with the motor chamber. The dust-collecting means is mounted in the dust-collecting chamber, and the dust-collecting chamber is connected to the suction port via an extension pipe.

When the vacuum motor is driven, it generates a powerful suction force at the suction port. Due to the suction force, the air, including the dust and dirt, is drawn in through the suction port and flows into the dust-collecting means mounted in the dust-collecting chamber of the cleaner body. While the air passes through the dust-collecting means and is discharged out of the cleaner body, the dust and dirt are collected at the dust-collecting means without passing through the dust-collecting means.

Generally, such a vacuum cleaner uses a paper filter as the dust-collecting means. The paper filter is a disposable product that has to be replaced with a new filter when the filter becomes full of dirt. Accordingly, replacement paper filters cause an increase in the cost associated with use of the vacuum cleaner.

Meanwhile, a vacuum cleaner employing a reusable filter, instead of a disposable paper filter, has been recently developed. This reusable filter may be removed from a cleaner body to be emptied out when it becomes full of dirt. Since the vacuum cleaner employing the reusable filter can repeatedly use the filter, it solves the above problem of the cost increase due to the replacement of a disposable paper filter.

However, the vacuum cleaner employing the reusable filter has a different dust-collecting chamber from that of the vacuum cleaner employing the disposable paper filter. Therefore, reusable filters cannot be employed as a substitute for paper filters in the vacuum cleaner designed to use paper filters. That is, there is no compatibility in using the reusable filter in the two types of vacuum cleaner. Thus, it is required for a manufacturer to develop a separate vacuum cleaner employing the paper filter and a vacuum cleaner employing the reusable filter. Accordingly, costs increase for the research and development of two separate product lines, and costs increase for the manufacturing equipment. Also, there is the problem that a consumer has to bear the increased costs for the two types of vacuum cleaner.

SUMMARY OF THE INVENTION

The present invention has been developed in order to solve the above-noted problems in the related art. Accordingly, it is an object of the present invention to provide a vacuum cleaner in which both a disposable paper filter and a reusable filter may be selectively mounted. Accordingly, the advantages of reducing the investment in the development of products, equipment to manufacture the products, and in reducing the maintenance and repair costs to the consumer arise.

In order to achieve the above objects, a vacuum cleaner is provided according the present invention, comprising: a cleaner body having a motor chamber in which a vacuum motor is mounted and a dust-collecting chamber which is divided from the motor chamber by a partition and is in fluid communication with the motor chamber via a passage path formed on the partition, the dust-collecting chamber being provided with an air inflow hole formed at a side thereof and having access to the outside; and a dust-collecting means mounted in the dust-collecting chamber of the cleaner body, for separating and collecting dust and dirt from the air that is drawn in through the air inflow hole, wherein the dust-collecting means includes a disposable paper filter and a reusable filter, and the dust collecting chamber is provided with a filter supporting means for stably supporting either the paper filter or the reusable filter.

The filter supporting means comprises a pair of first fixing guides disposed at both sidewalls of the air inflow hole of the dust-collecting chamber, and which are opposed to each other, for supporting the paper filter mounted in the dust-collecting chamber; and pairs of second and third fixing guides disposed at both sidewalls of the dust-collecting chamber, each pair opposed to each other and having a predetermined distance from each other, the second and third fixing guides for supporting the reusable filter mounted in the dust-collecting chamber in at least two positions.

The second and third fixing guides protrude inwardly from the sidewalls of the dust-collecting chamber, and the reusable filter has first and second guide grooves formed on an outer wall thereof, the second and third fixing guides slidably fit into the first and second guide grooves.

The reusable filter comprises a filter body including a front surface having a first opening; upper and lower surfaces extending from upper and lower sides of the front surface; side-surfaces extending from both sides of the front surface and having first and second guide grooves formed therein; and a rear surface extending from the upper and lower surfaces, and both side-surfaces, and having a second opening; a door hinged on the front surface and pivoting to open and close the first opening, and having a passage hole formed at a center thereof, the passage hole being in fluid communication with the air inflow hole of the dust-collecting chamber; a rear filter; and a fixing means for removably mounting the rear filter over the second opening.

The fixing means includes: a filter mounting portion having four pieces which extend inwardly from the second opening to support the upper, lower, right, and left surfaces and a rear surface edge of the rear filter; a rib having fixing grooves disposed at right, left, and lower sides of the second opening: and a fixing frame fitted into the fixing grooves of the rib, for supporting a front surface edge of the rear filter.

The filter body optionally has a pair of holding grooves formed on an upper surface thereof to assist the user in handling the cover.

Also, the reusable filter alternately comprises a filter body including a front surface having an opening; a lower surface extending from a lower side of the front surface; side-surfaces extending from both sides of the front surface and having first and second guide grooves formed thereon; a rear surface extending from the lower surface and both side-surfaces; and a cover removably connected with the opening of the filter body, the filter being made of porous plastic and thus functioning as a filter.

DETAILED DESCRIPTION OF THE PREFERRED EMBODIMENTS

The above object and advantages of the present invention become more apparent by the following description of the preferred embodiments of the present invention with reference to the accompanying drawings.

Figure 1:
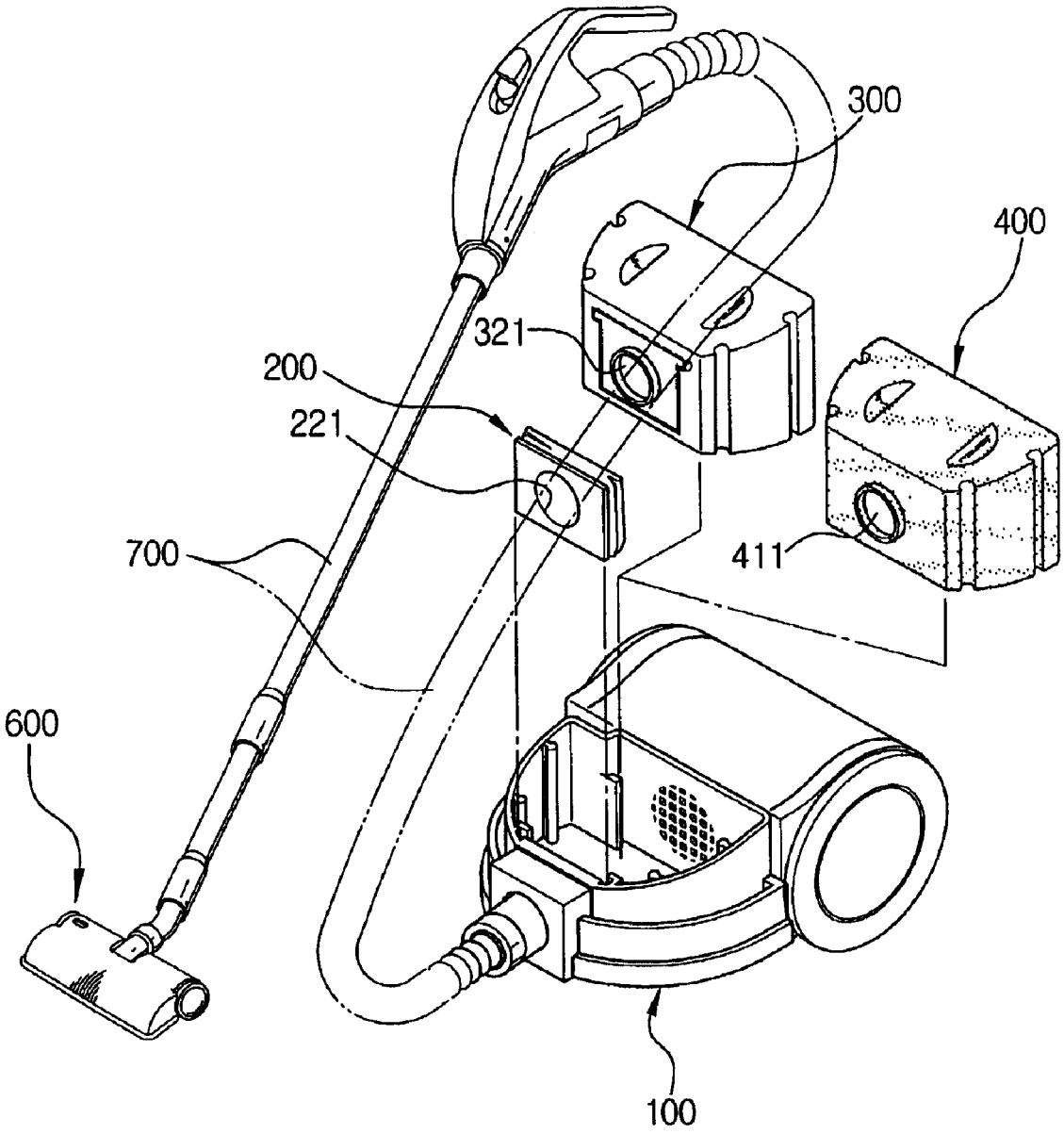
FIG. 1 is a perspective view showing a vacuum cleaner in accordance with a preferred embodiment of the present invention.

FIG. 1 shows a vacuum cleaner according to the preferred embodiment of the present invention. As shown in FIG. 1, the vacuum cleaner comprises a cleaner body 100, a paper filter 200 and first and second reusable filters 300 and 400 comprising a dust-collecting means. The paper filter 200 is disposable and may be replaced with a new filter when the used paper filter is full of dirt. The first and second filters 300 and 400 are reusable, and can be emptied out when filled with dirt. In the present invention, both the paper filter 200 and the reusable filters 300 and 400 are separately employed and selectively used.

Figure 2:
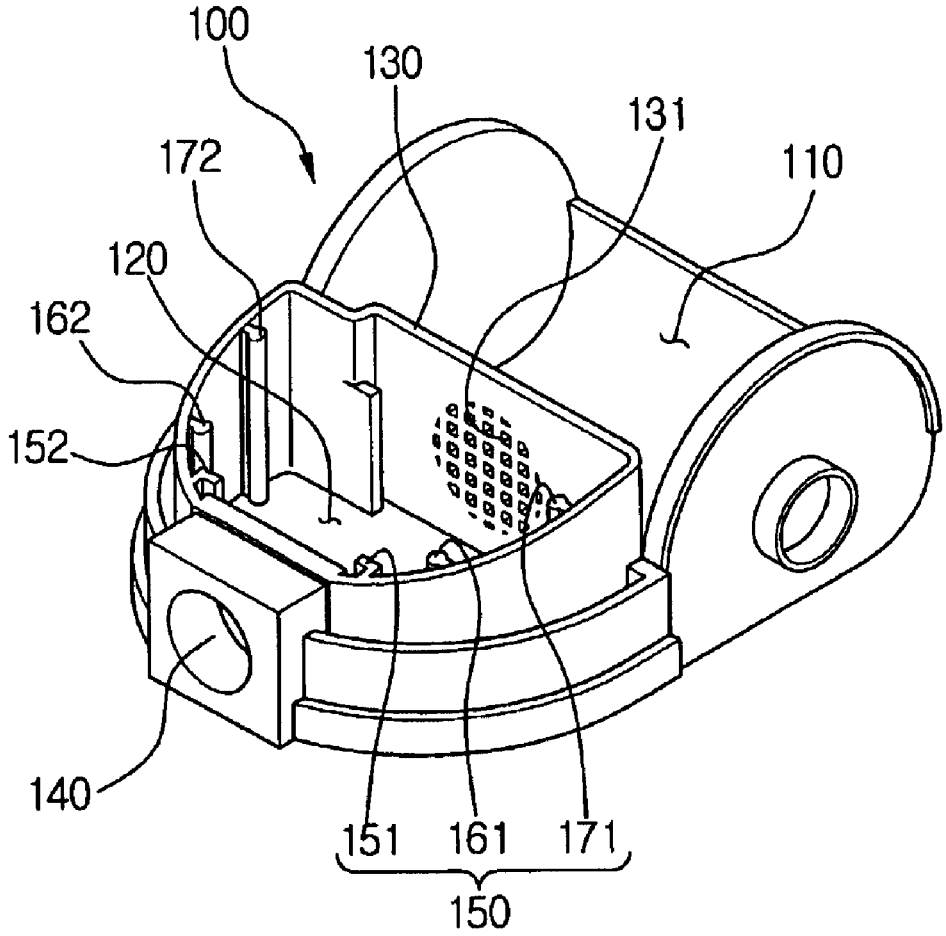
FIG. 2 is a perspective view showing the cleaner body of the vacuum cleaner of FIG. 1.

As shown in FIG. 2, the cleaner body 100 comprises a motor chamber 110 and a dust-collecting chamber 120. In the motor chamber 110 is mounted a vacuum motor 500 (FIG. 3A) that acts as a vacuum-generating device. Selectively mounted in the dust-collecting chamber 120 is the paper filter 200, the first reusable filter 300, or the second reusable filter 400.

The motor chamber 110 and the dust-collecting chamber 120 are divided from each other by a partition 130, and are in fluid communication with each other via a passage path, such as apertures 131, formed on the partition 130. The dust-collecting chamber 120 is provided with an air inflow hole 140 having access to the outside. For example, the air inflow hole 140 is connected to a suction port 600 via an extension pipe 700.

Also, as shown in FIG. 2, the dust-collecting chamber 120 of the cleaner body 100 is provided with a filter supporting means 150 for supporting either the paper filter 200 or one of the reusable filters 300 and 400, to maintain a stable mounting condition for the paper filter 200 and the permanent filters 300 and 400, regardless of which filter is mounted in the dust-collecting chamber 120. Due to the presence of the filter supporting means 150, the air inflow hole 140 and passage holes 221, 321, 411 (FIG. 1) of the paper filter 200 and the permanent filters 300 and 400, respectively, are aligned with each other.

Referring again to FIG. 2, the filter supporting means 150 comprises a pair of first fixing guides 151, 152 for supporting the paper filter 200 when mounted in the dust-collecting chamber 120, and two pairs of fixing guides, i.e. second fixing guides 161, 162, and third fixing guides 171, 172 for supporting either the reusable filters 300 or 400 when mounted in the dust-collecting chamber 120. The first fixing guides 151 and 152 are disposed at both sidewalls of the air inflow hole 140, and are opposed to each other, for receiving a supporting part 220 (see FIGS. 3A and 3B) of the paper filter 200 therein. The second and third fixing guides 161, 162 and 171, 172 are disposed at both sidewalls of the dust-collecting chamber 120. Second fixing guides 161, 162 and third fixing guides 171, 172 each comprise pairs that are oriented to oppose each other and are separated from each other by a predetermined separation distance, and are configured to support the reusable filters 300 and 400 in at least two positions.

The second and third fixing guides 161, 162 and 171, 172, respectively, protrude inwardly from both sidewalls of the dust-collecting chamber 120. Correspondingly, as shown in FIGS. 7B and 9B, the first and second reusable filters 300 and 400, respectively, have first and second guide grooves 314*a*, 314*b*, 315*a*, 315*b*, and 414*a*, 414*b*, 415*a*, 415*b*, respectively, formed on an outer-wall thereof. The second and third fixing guides 161, 162 and 171, 172 slidably fit in the first and second guide grooves 314*a*, 314*b*, 315*a*, 315*b* and 414*a*, 414*b*, 415*a*, 415*b*, respectively.

Figure 3A:
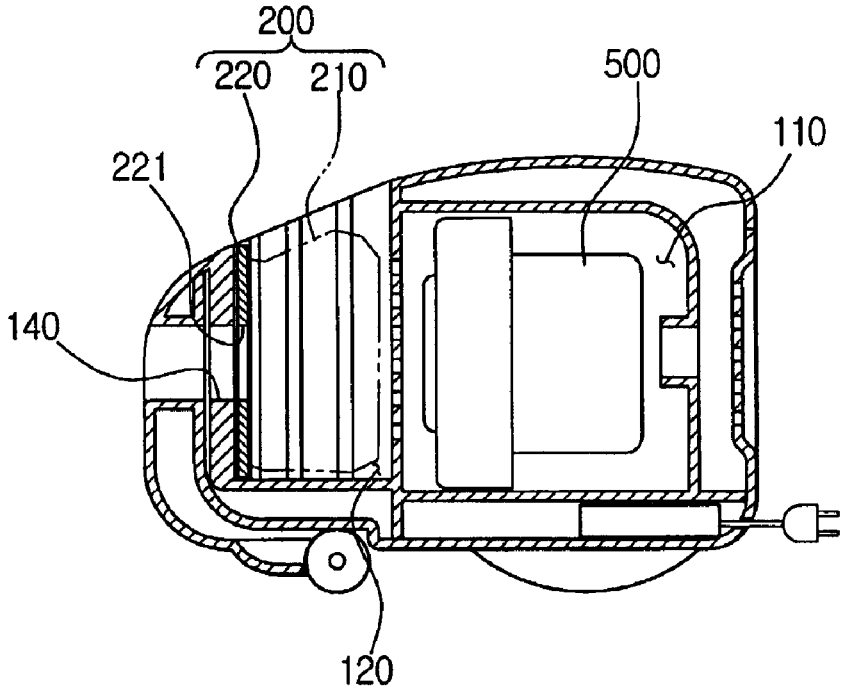
FIGS. 3A and 3B are a cross-sectional view and a plan view, respectively, showing a paper filter mounted in the dust-collecting chamber of a vacuum cleaner as a dust-collecting means in accordance with the preferred embodiment of the present invention.
Figure 3B:
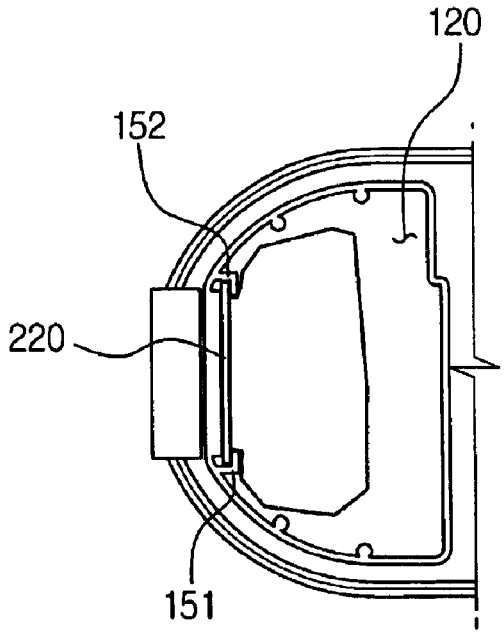

FIGS. 3A and 3B are a cross-sectional view and a plan view showing the paper filter 200 mounted in the dust-collecting chamber 120 of the cleaner body 100. The paper filter 200 comprises a dust-collecting part 210 and a supporting part 220 that has a passage hole 221. The paper filter 200 is mounted in the dust-collecting chamber 120 with the supporting part 220 being supported by the first fixing guides 151 and 152. The passage hole 221 of the paper filter 200 is mounted in the dust-collecting chamber 120 and is in fluid communication with the air inflow hole 140. Accordingly, the air including dust and dirt that is drawn in through the air inflow hole 140 passes through the paper filter 200. At this point, the dust and dirt are separated and collected from the air by the paper filter 200, while the air is discharged through the paper filter 200.

Figure 4:
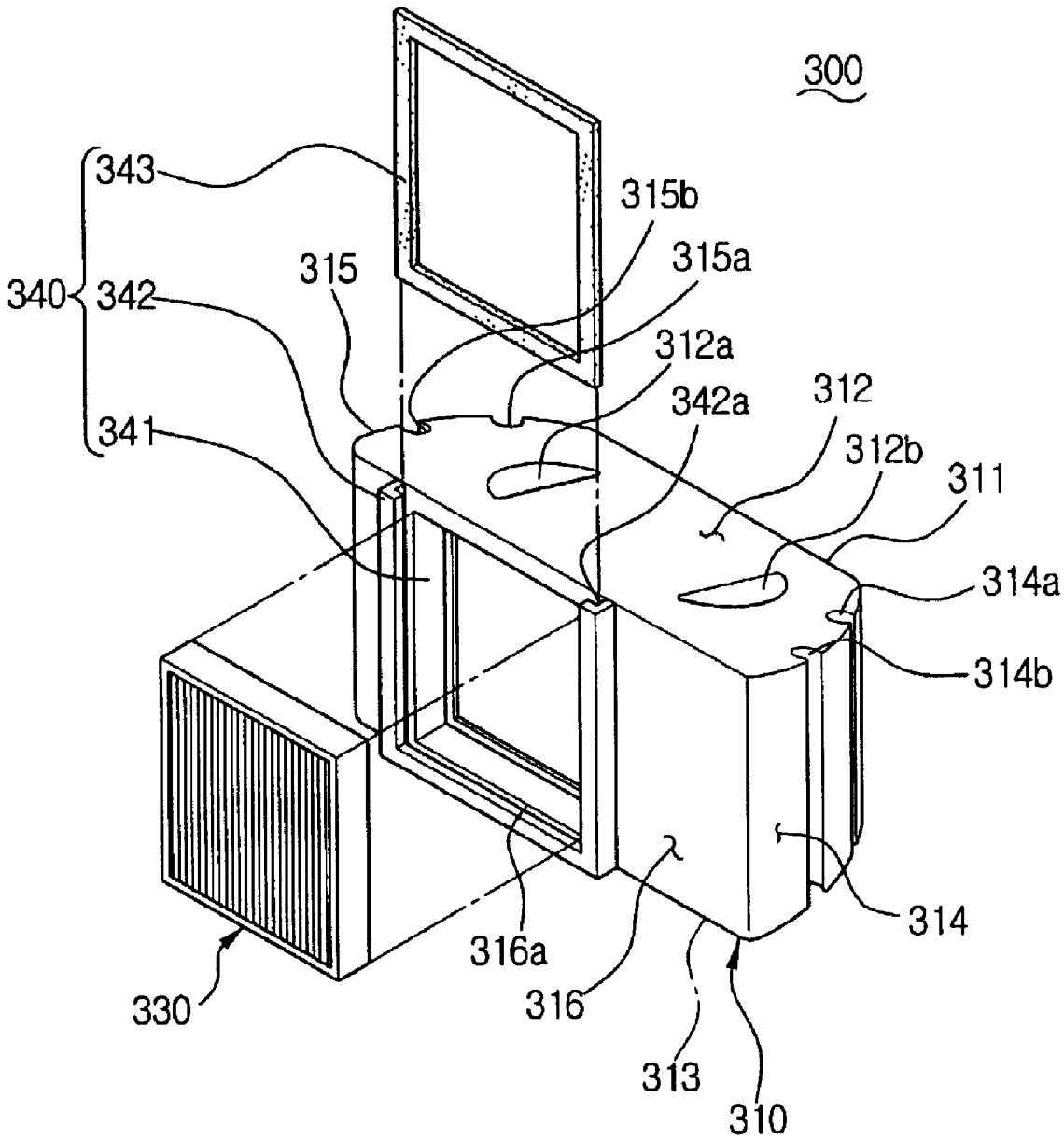
FIG. 4 is an exploded perspective view showing a reusable filter employed in a vacuum cleaner as a dirt-collecting means according to the preferred embodiment of the present invention.
Figure 5:
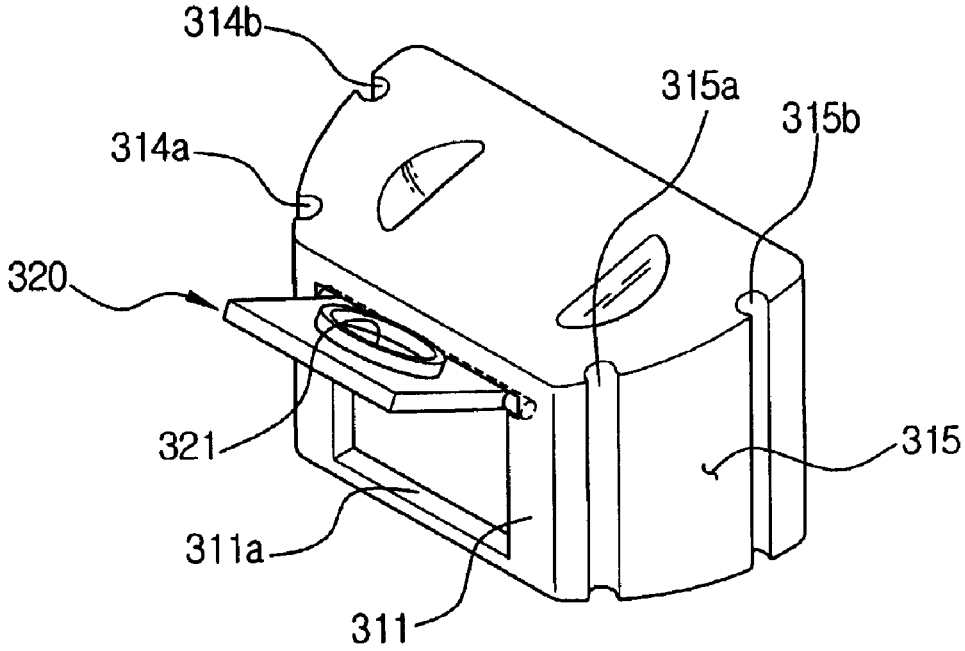
FIG. 5 is a perspective view showing the reusable filter of FIG. 4 with the cover opened in an assembled state.
Figure 6:
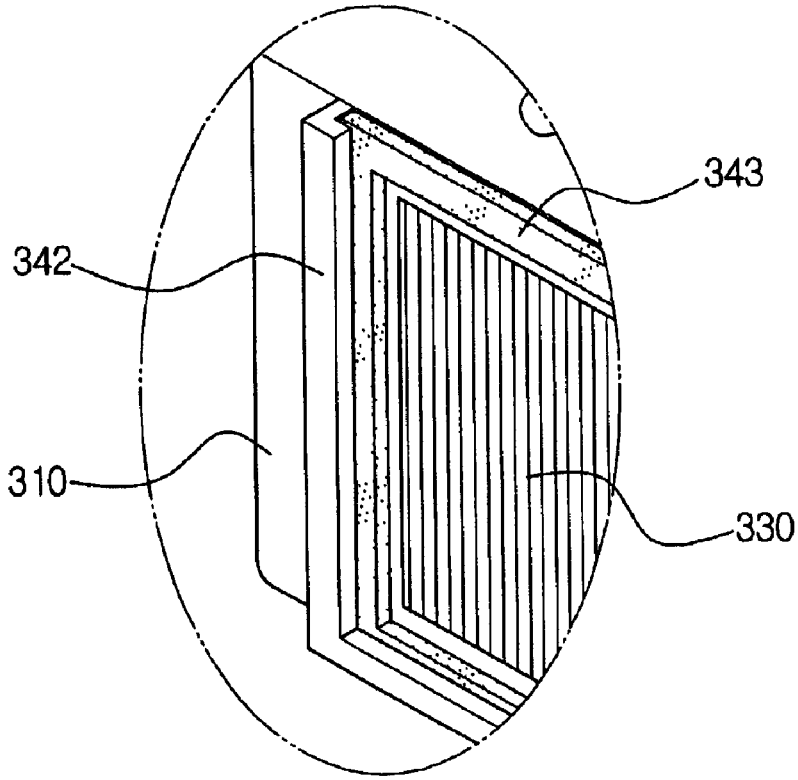
FIG. 6 is an enlarged detail view showing a filter supporting means for the reusable filter of FIG. 5.

FIGS. 4 through 6 are views showing the first reusable filter 300 of the vacuum cleaner according to the preferred embodiment of the present invention. As shown in FIGS. 4 through 6, the first reusable filter 300 comprises a filter body 310 having an exterior profile similar to the shape of the dust-collecting chamber 120 of the cleaner body 100, a door 320, a rear filter 330, and a fixing means 340.

The filter body 310 has a front surface 311 with a first opening 311*a* (FIG. 5), upper and lower surfaces 312 and 313 extending from upper and lower sides of the front surface 311, side surfaces 314 and 315 extending from both sides of the front surface 311, and a rear surface 316 extending from the upper and lower surfaces 312 and 313 and the side surfaces 314 and 315, and having a second opening 316*a*. In the side surfaces 314 and 315 are provided first and second guide grooves 314*a*, 314*b*, 315*a*, 315*b* in which the second and third fixing guides 161, 162 and 171, 172 are received. Also, the upper surface 312 is provided with a pair of holding grooves 312*a* and 312*b* for allowing the first reusable filter 300 to be easily mounted in the dust-collecting chamber 120.

The door 320 is hinged on the front surface 311 and pivots to open and close the first opening 311*a*, and has the passage hole 321 formed at a center thereof, for being in fluid communication with the air inflow hole 140 of the dust-collecting chamber 120.

The rear filter 330 is removably mounted in the second opening 316*a* of the rear surface 316 by the fixing means 340 which will be described below. The rear filter 330 functions to discharge the air drawn in through the air inflow hole 140 therethrough and simultaneously filter the minute particle dust out of the air during the discharging process. Among the various types of the filters that are available for use in rear filter 330, the preferred embodiment employs a filter made of unwoven fabric, by way of example.

The fixing means 340 comprises a filter mounting portion 341, a rib 342, and a fixing frame 343. The filter mounting portion 341 comprises four supporting pieces which are extended inwardly from the second opening 316*a* for supporting upper, lower, left and right surfaces of the rear filter 330. Each supporting piece has a bending portion formed at an end thereof, for supporting a rear surface edge of the rear filter 330. The rib 342 is disposed at an outside of the second opening 316*a*, i.e., right, left and lower sides of the second opening 316*a*. The rib 342 is provided with a fixing groove 342*a*. The fixing frame 343 is configured and shaped in the form of a square so as to be inserted into the fixing groove 342*a* of the rib 342. The width of a side of the fixing frame 343 is larger than the depth of the fixing groove 342*a*. Accordingly, when the fixing frame 343 is fitted into the fixing groove 342*a* of the rib 342 after the filter 330 is mounted on the filter-mounting portion 341, the fixing frame 343 supports a front surface edge of the filter 330 to maintain the mounting of the filter 330. The filter 330 is separated from the filter-mounting portion 341 by removing the fixing frame 343 from the rib 342.

Figure 7A:
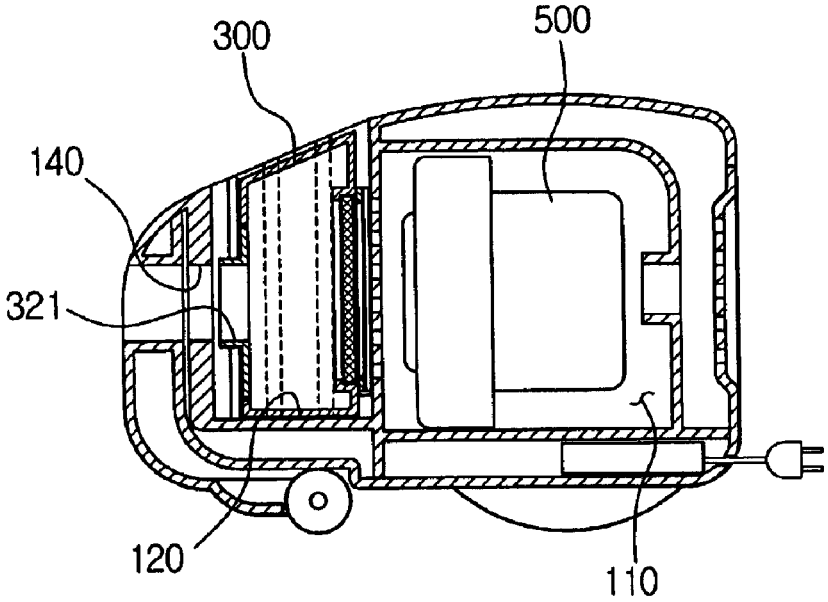
FIGS. 7A and 7B are a cross-sectional view and a plan view, respectively, showing the reusable filter of FIG. 4 mounted in the dust-collecting chamber of a vacuum cleaner as a dirt-collecting means in accordance with the preferred embodiment of the present invention.
Figure 7B:
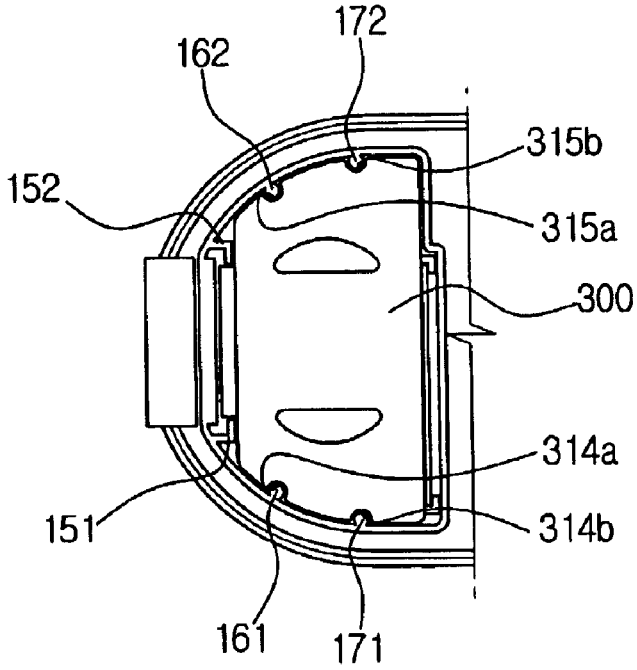

FIGS. 7A and 7B are a cross-sectional view and a plan view showing the first reusable filter 300 mounted in the dust-collecting chamber 120 of the cleaner body 100. As shown in the FIGS. 7A and 7B, the first reusable filter 300 is mounted in the dust-collecting chamber 120 in a manner such that the second and third fixing guides 161, 162 and 171, 172 of the dust-collecting chamber 120 are inserted into the first and second guide grooves 314*a*, 314*b* and 315*a*, 315*b*, respectively, disposed on the side surfaces 314 and 315 of the first reusable filter 300. Accordingly, the first reusable filter 300 has a passage hole 321 aligned with the air inflow hole 140 of the dust-collecting chamber 120 when mounted within the dust-collecting chamber 120.

When the vacuum motor 500 is driven, the air, including the dust and dirt, is drawn in through the suction port 600 and flows into the first reusable filter 300 through the air inflow hole 140 and the passage hole 321. The dust and dirt are filtered and collected from the air by the first reusable filter 300, while the clean air is discharged out through the filter 330. Meanwhile, the first reusable filter 300 is removed from the dust-collecting chamber 120 to be emptied out when filled with dirt, and is then re-mounted in the dust-collecting chamber 120 to be re-used.

Figure 8:
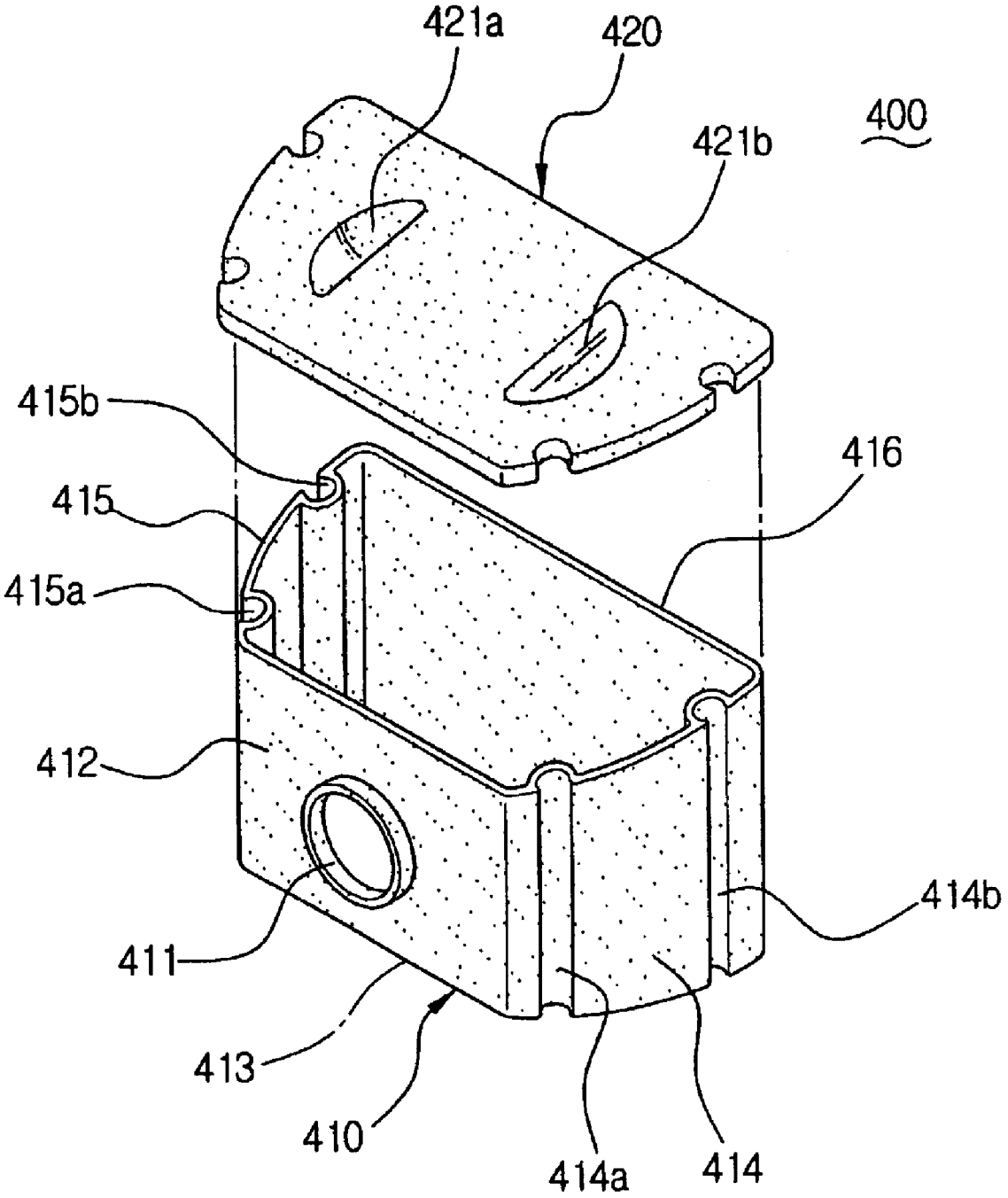
FIG. 8 is a perspective view showing an alternative embodiment of a reusable filter employed in a vacuum cleaner as a dust-collecting means in accordance with another preferred embodiment of the present invention.

FIG. 8 is a perspective view showing the second reusable filter 400 mounted in the vacuum cleaner according to another preferred embodiment of the present invention. As shown in FIG. 8, the second reusable filter 400 comprises a filter body 410 having an opened upper end and a cover 420 removably connected with the opened upper end of the filter body 410.

The filter body 410 has the same exterior profile as the first reusable filter 300 described above, i.e., similar to the inner shape of the dust-collecting chamber 120 of the cleaner body 100. More specifically, the filter body 410 includes a front surface 412 having a passage hole 411, a lower surface 413 extending from a lower side of the front surface 412, side surfaces 414 and 415 extending from both sides of the front surface 412 and having first and second guide grooves 414*a*, 414*b* and 415*a*, 415*b* for receiving the second and third fixing guides 161, 162 and 171, 172 of the dust-collecting chamber 120 therein, and a rear surface 416 extending from the lower surface 413 and both side surfaces 414 and 415. The filter body 410 of the second reusable filter 400 is made of porous plastic. Therefore, an extra filter is not required as the filter body 410 functions as a filter.

The cover 420 is provided to empty out the second reusable filter 400 when the second reusable filter 400 is full of dirt. Preferably, the cover 420 is made of porous plastic, but this should not be considered as limiting. The cover 420 is provided with holding grooves 421*a* and 421*b* formed on an upper surface of the cover 420 to permit a user to hold the cover 420 during the emptying process.

Figure 9A:
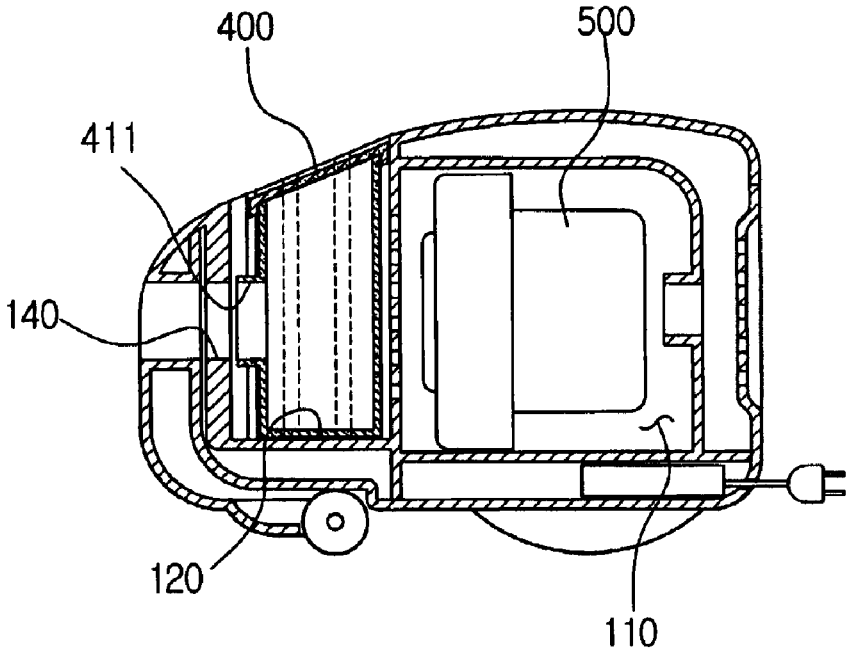
FIGS. 9A and 9B are a cross-sectional view and a plan view, respectively, showing the reusable filter of FIG. 8 mounted in the dust-collecting chamber of a vacuum cleaner as a dirt-collecting means according to the preferred embodiment of the present invention.
Figure 9B:
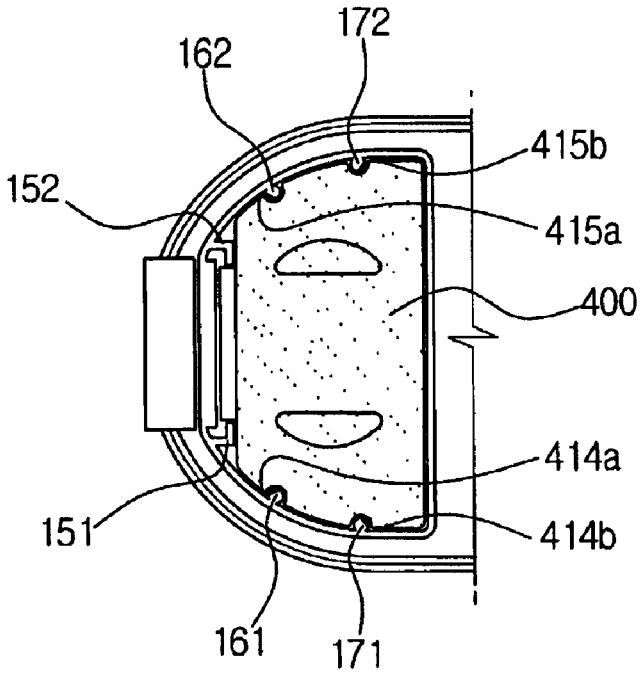

FIGS. 9A and 9B are a cross-sectional view and a plan view showing the second reusable filter 400 mounted in the dust-collecting chamber 120 of the cleaner body 100. As shown in FIGS. 9A and 9B, the second reusable filter 400 is mounted in the dust-collecting chamber 120 in a manner that the second and third fixing guides 161, 162 and 171, 172 of the dust-collecting chamber 120 are inserted into respective first and second guide grooves 414*a*, 414*b* and 415*a*, 415*b* disposed on the side surfaces 414 and 415 of the second reusable filter 400. Accordingly, the second reusable filter 400 includes a passage hole 411 aligned with the air inflow hole 140 of the dust-collecting chamber 120, when mounted in the dust-collecting chamber 120.

When the vacuum motor 500 is driven, the dust and dirt-laden air is drawn in through the suction port 600 and flows into the second reusable filter 400 via the air inflow hole 140 and the passage hole 411 of the second reusable filter 400. The dust and dirt are filtered and collected from the air by the second reusable filter 400, while the clean air is discharged through the rear surface of the second reusable filter 400. At this point, since the second reusable filter 400 is made of porous plastic or other similar material, the air easily passes through the second reusable filter 400. Meanwhile, the second reusable filter 400 may be removed from the dust-collecting chamber 120 to be emptied out when filled with dirt and is re-mounted in the dust-collecting chamber 120 to be re-used.

According to the present invention, a vacuum cleaner that can use either the paper filter 200 or the reusable filter 300 or 400 is provided. Thus, the consumer can use either the paper filter 200, the reusable filter 300, or the second reusable filter 400, selectively.

When the paper filter 200 can not be used because it is full of dirt, the user may instead use either the reusable filters 300 or 400 without replacing the paper filter 200 with a new filter. Unlike the disposable paper filter 200, the reusable filters 300 and 400 are re-usable by removing the dirt from the reusable filters 300 and 400. Accordingly, the user is not required to purchase a new filter.

According to the present invention, as both of the paper filter 200 and the reusable filters 300 and 400 can be selectively mounted in one vacuum cleaner, manufactures are allowed to focus more on the research and development for this vacuum cleaner alone. Accordingly, there is the advantage of reducing the investment in the development of products and equipment. Also, from the standpoint of the consumer, it is also advantageous as there is no need for purchase or handling of additional paper filters, and thus there are less maintenance and repair costs for the vacuum cleaner.

Although the preferred embodiments of the present invention have been illustrated and described, it will be understood by those skilled in the art that the present invention should not be limited to the described preferred embodiments, but various changes and modifications can be made within the spirit and scope of the present invention as defined by the appended claims.

What is claimed is:

1. A vacuum cleaner comprising: a cleaner body having a motor chamber in which a vacuum motor is mounted, and a dust-collecting chamber which is divided from the motor chamber by a partition and is in fluid communication with the motor chamber via a passage path formed on the partition, the dust-collecting chamber being provided with an air inflow hole formed at a side thereof and filter supporting means that is comprised of paper filter fixing guides disposed at sidewalls of the air inflow hole that support a paper filter in the dust-collecting chamber, said filter supporting means being further comprised of reusuable filter fixing guides disposed at the sidewalls of the dust-collecting chamber, said reusable filter fixing guides being dimensioned and configured to support a reusable filter in the dust-collecting chamber; a dust-collecting means mounted in the dust-collecting chamber of the cleaner body, for separating and collecting dust and dirt from the air that is drawn in through the air inflow hole, and wherein the dust-collecting means includes a separate disposable paper filter and a separate reusable filter, and wherein said filter supporting means stably supports either the paper filter or the permanent filter within said dust-collecting chamber.

2. The vacuum cleaner of claim 1, wherein said paper filter fixing guides and said reusable filter guides disposed at sidewalls of the air inflow hole oppose each other.

3. The vacuum cleaner of claim 1, wherein said reusable filter fixing guides disposed at the sidewalls of the dust-collecting chamber comprise pairs of second and third fixing guides, each pair of said second and third fixing guides opposing each other.

4. The vacuum cleaner of claim 3, wherein the second and third fixing guides protrude inwardly from the both sidewalls of the dust-collecting chamber, and the reusable filter has first and second guide grooves formed at an outer wall thereof, and the second and third fixing guides slidably fit into the first and second guide grooves.

5. The vacuum cleaner of claim 4, wherein the reusable filter comprises a filter body including: a front surface having a first opening; upper and lower surfaces extending from upper and lower sides of the front surface; side surfaces extending from both sides of the front surface and having said first and second guide grooves formed therein; and a rear surface extending from the upper and lower surfaces and both side-surfaces and having a second opening; a door hinged on the front surface and pivoting to open and close the first opening, and having a passage hole formed at a center thereof the passage hole being in fluid communication with the air inflow hole of the dust-collecting chamber; a rear filter removably mounted on the second opening of the rear surface; and a fixing means for separately fixing the filter to the second opening.

6. The vacuum cleaner of claim 5, wherein the fixing means includes: a filter mounting portion having four pieces which extend inwardly from the second opening to support the upper, lower, right, and left surfaces and a rear surface edge of the filter; a rib disposed at an outside of the second opening and having fixing grooves disposed at right, left, lower sides of the second opening: and a fixing frame fitted into the fixing grooves of the rib, for supporting a front surface edge of the filter.

7. The vacuum cleaner of claim 5, wherein the filter body includes a pair of holding grooves formed on an upper surface thereof.

8. The vacuum cleaner of claim 1, wherein said reusable filter fixing guides disposed at the sidewalls of the dust-collecting chamber are dimensioned and configured to support the reusable filter in at least two positions when mounted in the dust-collecting chamber.

9. The vacuum cleaner of claim 1, wherein the reusable filter comprises a filter body made of porous plastic.

10. The vacuum cleaner of claim 9, wherein said filter body further comprises: a front surface having an opening; a lower surface extending from a lower side of the front surface; side surfaces extending from sides of the front surface and having the first and second guide grooves formed thereon; and a rear surface extending from the lower surface and side surfaces; and a cover removably connected with the opening of the filter body.

* * * * *